US005797722A

United States Patent [19]

Sasaki et al.

[11] Patent Number: 5,797,722

[45] Date of Patent: Aug. 25, 1998

[54] FLUID PUMP

[75] Inventors: Norio Sasaki, Aichi-ken; Itsuro Hashiguchi, Toyota, both of Japan

[73] Assignee: Toyota Jidosha Kabushiki Kaisha, Toyota, Japan

[21] Appl. No.: 845,479

[22] Filed: Apr. 25, 1997

[30] Foreign Application Priority Data

Apr. 26, 1996 [JP] Japan ..... 8-107998

[51] Int. Cl.[6] ..... F04D 29/08

[52] U.S. Cl. ..... 415/170.1; 415/174.2

[58] Field of Search ..... 415/170.1, 174.2, 415/174.3, 230, 231

[56] References Cited

U.S. PATENT DOCUMENTS

| | | | |
|---|---|---|---|
| 1,198,558 | 9/1916 | Lawaczeck | 415/174.2 |
| 2,240,356 | 4/1941 | Tessmer | 415/174.3 |
| 5,607,285 | 3/1997 | Eckel | 415/230 |

*Primary Examiner*—John T. Kwon
*Attorney, Agent, or Firm*—Oliff & Berridge, PLC

[57] ABSTRACT

A fluid pump includes a housing body mounted to a mounting plate in a liquid-tight manner, a pump shaft having a journal portion rotatably supported on the mounting plate and a cylindrical cam portion integrally formed with one end of the journal portion located in the housing body, an impeller mounted on the other end of the pump shaft immersed in hydraulic fluid at a backside of the mounting plate, a drive shaft rotatably mounted within the housing body to be applied with a drive torque and positioned coaxially with the journal portion of the pump shaft, the drive shaft being formed with an eccentric bore the center axis of which is radially displaced from the center axis of the journal portion, a carrier having a cylindrical cap portion rotatably coupled with the cylindrical cam portion of the pump shaft and a shaft portion integrally formed with the cylindrical cap portion coaxially therewith and rotatably coupled within the eccentric bore of the drive shaft, and a diaphragm of elastic material coupled at one end thereof with the cylindrical cap portion of the carrier and fixed at the other end thereof to an internal surface of the mounting plate in a liquid-tight manner to seal the journal portion and cylindrical cam portion of the pump shaft located in the housing body.

3 Claims, 1 Drawing Sheet

FLUID PUMP

BACKGROUND OF THE INVENTION

1. Field of the Invention

The present invention relates to a fluid pump, and more particularly to a fluid pump used as a cooling-water pump driven by an electric motor or a water-cooled engine to circulate cooling water in the engine.

2. Description of the Prior Art

In a conventional fluid pump of the direct drive type, a pump shaft sealed by a mechanical seal at its intermediate portion has an outer end exposed to the atmospheric air to be applied with a drive torque and an inner end immersed in hydraulic fluid for rotating an impeller mounted thereon. In the fluid pump, the impeller is steadily driven by the drive torque applied from the pump shaft, and the sliding surface of the mechanical seal is lubricated by the hydraulic fluid. However, if foreign particles are contained in the hydraulic fluid, the mechanical seal is damaged due to defacement caused by the foreign particles adhered thereto. It is, therefore, difficult to completely seal the pump shaft for a long period of time.

In a conventional fluid pump of the indirect drive type, an impeller of the pump is magnetically coupled with a permanent magnet located outside the pump to be applied with a drive torque. Although in the fluid pump of this type, the support shaft of the impeller is completely sealed, it is difficult to steadily rotate the impeller in response to fluctuation of the drive torque. In addition, the fluid pump becomes large in size and costly due to use of a large number of permanent magnets.

SUMMARY OF THE INVENTION

It is, therefore, a primary object of the present invention to provide a fluid pump the pump shaft of which is completely sealed in a simple construction and acts to steadily transmit a drive torque to an impeller mounted thereon.

According to the present invention, the object is accomplished by providing a fluid pump which comprises a housing assembly including a mounting plate and a housing body mounted to the mounting plate in a liquid-tight manner, a pump shaft having a journal portion rotatably supported on the mounting plate and a cylindrical cam portion integrally formed with one end of the journal portion located in the housing body, the cam portion being placed eccentrically from a center axis of the journal portion, an impeller mounted on the other end of the pump shaft located at a backside of the mounting plate, a drive shaft rotatably mounted within the housing body to be applied with a drive torque and positioned coaxially with the journal portion of the pump shaft, the drive shaft being formed with an eccentric bore the center axis of which is radially displaced from the center axis of the journal portion, a carrier having a cylindrical cap portion rotatably coupled with the cylindrical cam portion of the pump shaft and a shaft portion integrally formed with the cylindrical cap portion coaxially therewith and rotatably coupled within the eccentric bore of the drive shaft, and a diaphragm of elastic material coupled at one end thereof with the cylindrical cap portion of the carrier and fixed at the other end thereof to an internal surface of the mounting plate in a liquid-tight manner to seal the journal portion and cylindrical cam portion of the pump shaft located in the housing body.

In the fluid pump, it is preferable that the journal portion of the pump shaft is supported by a sliding bearing fixedly coupled within an axial bore formed in the mounting plate, and the cylindrical cam portion of the pump shaft is supported by a sliding bearing fixedly coupled within the cylindrical cap portion of the carrier.

BRIEF DESCRIPTION OF THE DRAWING

Other objects, features and advantages of the present invention will be more readily appreciated from the following detailed description of a preferred embodiment thereof when taken together with the accompanying drawing, in which a single FIGURE illustrates a vertical section of a fluid pump in accordance with the present invention.

Illustrated in the drawing is a fluid pump P used as a cooling-water pump driven by a water-cooled engine (or an electric motor) to circulate cooling water in the engine. The fluid pump P includes a mounting plate 12 of aluminum alloy fixed to an end face of a cylinder block 11 of the engine in a liquid-tight manner, a housing body 14 of aluminum alloy mounted to the mounting plate 12 by means of fastening bolts 13, and a pump shaft 21, a carrier 22, a drive shaft 23 and a diaphragm 24 of elastic material assembled within the housing body 14. The pump shaft 21, carrier 22 and drive shaft 23 each are made of steel.

Figure 1:
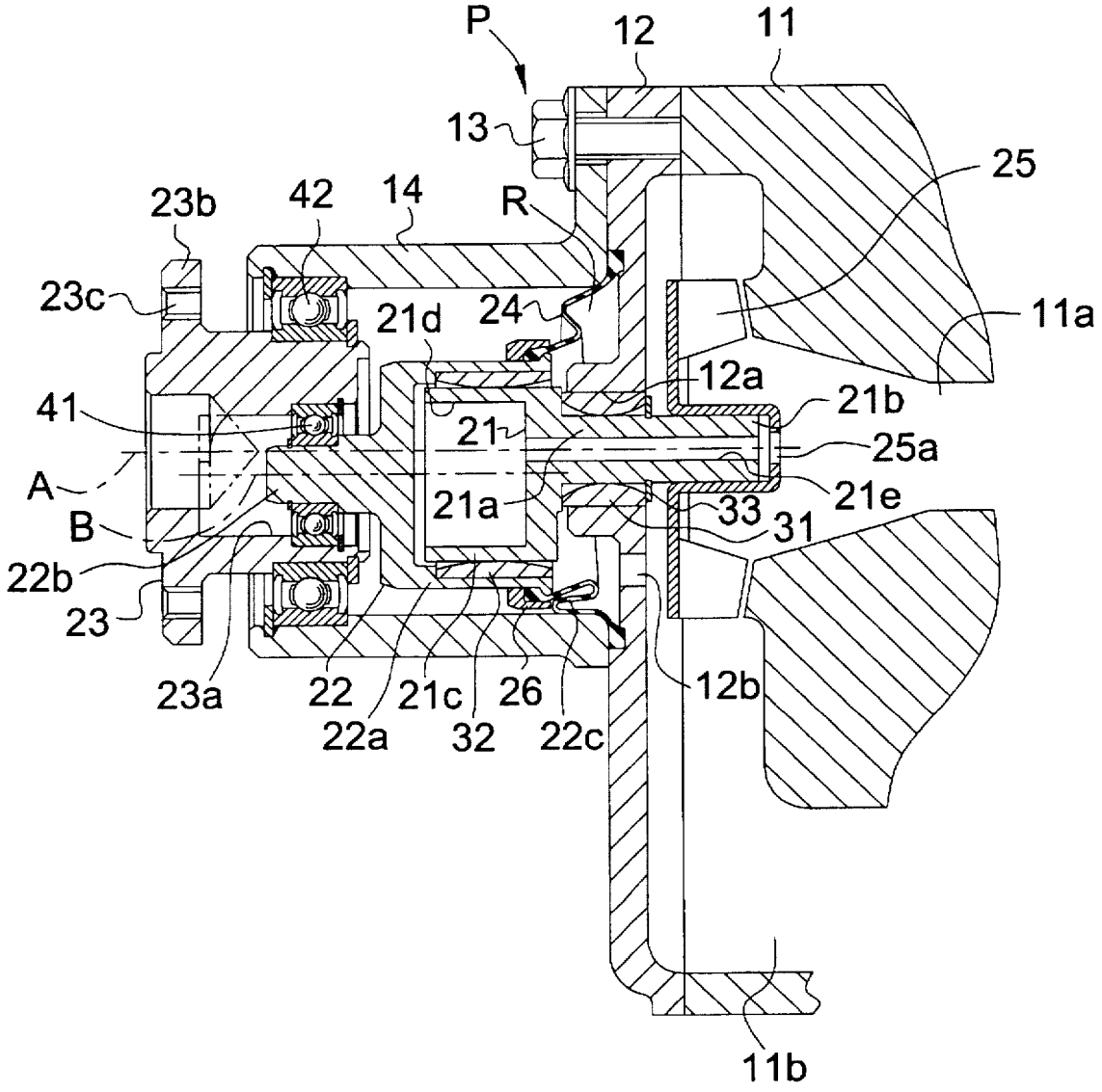

The pump shaft 21 is in the form of a hollow shaft which has a journal portion **21*a* rotatably supported by a sliding bearing 31 and a cylindrical cam portion 21*c* integrally formed with the journal portion 21*a*. The sliding bearing 31 is fixedly coupled within an axial bore 12*a* formed in the mounting plate 12. A center axis B of cylindrical cam portion 21*c* is displaced eccentrically from a center axis A of the journal portion 21*a*. An impeller 25 made of stainless steel is mounted on one end 21*b* of journal portion 21*a*** for rotation therewith.

The carrier 22 is formed with a cylindrical cap portion **22*a* rotatably coupled with the cylindrical cam portion 21*c* of pump shaft 21 through a sliding bearing 32 and a solid shaft portion 22*b* coaxial with the cylindrical cap portion 22*a*. The shaft portion 22*b* of carrier 22 is rotatably supported by a sealed ball bearing 41 which is coupled with an eccentric bore 23*a* formed in the drive shaft 23** and positioned in place by means of a pair of annular retainers.

The drive shaft 23 is rotatably supported by a sealed ball bearing 42 which is coupled within the housing body 14 concentrically with the sliding bearing 31 of the journal portion **21*a* of pump shaft 21 and positioned in place by means of a pair of annular retainers. The drive shaft 23 has an annular flange 23*b* formed with a plurality of circumferentially equally spaced mounting holes 23*c*. A pulley (not shown) is fixed to the annular flange 23*b* of drive shaft 23 by means of fastening bolts threaded into the mounting holes 23*c* and is drivingly connected to an output shaft of the engine to rotate the drive shaft 23 about the center axis A of pump shaft 21**.

The diaphragm 24 of elastic material is formed at one end thereof with an annular bead coupled with the cylindrical cap portion **22*a* of carrier 22 at an annular protrusion formed thereon and fixed in place by means of an annular retainer ring 26. The diaphragm 24 is formed at the other end thereof with an annular bead coupled within an annular groove formed on the mounting plate 12 and fixed in place by engagement with an end face of housing body 14. Thus, the diaphragm 24 is arranged in surrounding relationship with the sliding bearings 31 and 32 for the pump shaft 21 and coupled at opposite ends thereof with the carrier 22 and the mounting plate 12 in a liquid-tight manner to seal the pump shaft 21**.

The impeller 25 is fixedly coupled with the inner end 21*b* of pump shaft 21 with press-fit for rotation therewith to circulate the cooling water from a suction passage 11*a* into a discharge passage 11*b* formed in the cylinder block of the engine. During rotation of the impeller 25, a portion of the cooling water is introduced into an internal cavity R of diaphragm 24 through a hole 12*b* in the mounting plate 12 to lubricate and cool the sliding surfaces of the bearings 31 and 32. The cooling water passing through the sliding bearing 31 flows toward the rear surface of impeller 25, while the cooling water passing through the sliding bearing 32 flows into the suction passage 11*a* through axial bores 21*d* and 21*e* of the pump shaft 21 and a center hole 25*a* of impeller 25.

The sliding bearing 31 is made of phenol resin and is formed semicircular in cross-section at its inner surface. The sliding bearing 31 is fixedly coupled within the bore 12*a* of mounting plate 12 with press-fit and positioned in place by an annular retainer 33 fixed to the pump shaft 21 in such a manner that the journal portion 21*a* of pump shaft 21 is positioned to be tiltable and slightly movable in an axial direction. Similarly, the sliding bearing 32 is made of phenol resin and is formed semicircular in cross-section at its inner surface. The sliding bearing 32 is fixedly coupled within the cylindrical cap portion 22*a* of carrier 22 with press-fit in such a manner that the cylindrical cam portion 21*c* of pump shaft 21 is positioned in place to be tiltable and slightly movable in an axial direction.

In the fluid pump P described above, the pump shaft 21 is completely sealed by the diaphragm 24 to eliminate leakage of the cooling water to the exterior. When the drive shaft 23 is driven by the drive torque applied from the engine through the pulley, the carrier 22 revolves around the center axis A of pump shaft 31 and causes the cylindrical cam portion 21*c* to rotate about its center axis B. Thus, the pump shaft 21 is driven by rotation of the drive shaft 23 to rotate the impeller 25, and the cooling water is circulated by rotation of the impeller 25 from the suction passage 11*a* into the discharge passage 11*b*. During rotation of the drive shaft 23, the diaphragm 24 is radially deformed in accordance with revolution of the carrier 22, and the sliding bearings 31 and 32 are lubricated by the cooling water introduced into the internal cavity R of diaphragm 24 from the hold 12*b* of mounting plate 12.

As is understood from the above description, the sliding bearings 31, 32 for the pump shaft 21 in the fluid pump P are completely sealed by the diaphragm 24, and the drive torque of drive shaft 23 is transmitted to the pump shaft 21 through the carrier 22. Since in the fluid pump P, the sliding bearings 31, 32 for the pump shaft 21 are formed semicircular in cross-section at their inner surfaces, smooth rotation of the pump shaft 21 and carrier 22 is effected even if the pump shaft 21 is tilted on the mounting plate 12 or the carrier 22 is tilted relatively to the pump shaft 21.

What is claimed is:

1. A fluid pump comprising:

a housing assembly including a mounting plate and a housing body mounted to said mounting plate in a liquid-tight manner;

a pump shaft having a journal portion rotatably supported on said mounting plate and a cylindrical cam portion integrally formed with one end of said journal portion located in said housing body, said cam portion being placed eccentrically from a center axis of said journal portion;

an impeller mounted on the other end of said pump shaft located at a backside of said mounting plate;

a drive shaft rotatably mounted within said housing body to be applied with a drive torque and positioned coaxially with the journal portion of said pump shaft, said drive shaft being formed with an eccentric bore the center axis of which is radially displaced from the center axis of said journal portion;

a carrier having a cylindrical cap portion rotatably coupled with the cylindrical cam portion of said pump shaft and a shaft portion integrally formed with the cylindrical cap portion coaxially therewith and rotatably coupled within the eccentric bore of said drive shaft; and a diaphragm of elastic material coupled at one end thereof with the cylindrical cap portion of said carrier and fixed at the other end thereof to an internal surface of said mounting plate in a liquid-tight manner to seal the journal portion and cylindrical cam portion of said pump shaft located in said housing body.

2. A fluid pump as claimed in claim 1, wherein the journal portion of said pump shaft is supported by a sliding bearing fixedly coupled within an axial bore formed in said mounting plate, and the cylindrical cam portion of said pump shaft is supported by a sliding bearing fixedly coupled within the cylindrical cap portion of said carrier.

3. A fluid pump as claimed in claim 2, wherein the journal portion of said pump shaft is formed with an axial bore in open communication with an axial bore formed in the cylindrical cam portion, and wherein said sliding bearings for the journal portion and cylindrical cam portion of said pump shaft are lubricated by fluid introduced into an internal cavity of said diaphragm through a hole of said mounting plate.

* * * * *